US005118656A

United States Patent [19]

Minami et al.

[11] Patent Number: 5,118,656

[45] Date of Patent: Jun. 2, 1992

[54] HEAT-SENSITIVE RECORDING SHEET

[75] Inventors: Toshiaki Minami; Tadakazu Fukuchi; Reiji Ohashi; Toshio Kaneko, all of Tokyo, Japan

[73] Assignee: Jujo Paper Co., Ltd., Tokyo, Japan

[21] Appl. No.: 590,807

[22] Filed: Oct. 1, 1990

[30] Foreign Application Priority Data

Oct. 13, 1989 [JP] Japan ..... 1-267590

[51] Int. Cl.[5] ..... B41M 5/30

[52] U.S. Cl. ..... 503/209; 503/216; 503/217

[58] Field of Search ..... 427/150-152; 503/208, 209, 216, 217, 225

[56] References Cited

U.S. PATENT DOCUMENTS 4,814,320 3/1989 Kawaii et al. ..... 503/220

*Primary Examiner*—Bruce H. Hess

*Attorney, Agent, or Firm*—Sherman and Shalloway

[57] ABSTRACT

A heat-sensitive recording sheet has on a support a color-developing layer which comprises a colorless or pale colored basic chromogenic dye and an organic color-developing agent, wherein the organic color-developing agent comprises both 4-hydroxy-4'-n-propoxydiphenylsulfone and a particular phenolic substance. The sheet of this invention provides excellent writing quality and superior thermal responsibility.

9 Claims, No Drawings

HEAT-SENSITIVE RECORDING SHEET

BACKGROUND OF THE INVENTION

1. Field of the Invention

This invention relates to a heat-sensitive recording sheet having an improved writing quality in the use of oily ink.

2. prior Art

In general, a heat-sensitive recording sheet is produced by applying on a support, such as paper, synthetic paper, film, plastic, etc., a coating material which is prepared by individually grinding and dispersing a colorless chromogenic dye and an organic color-developing agent, such as phenolic material, etc., into fine particles, mixing the resultant dispersion with each other and then adding thereto binder, filler, sensitizer, slipping agent and other auxiliaries. The coating, when heated by thermal pen, thermal head, hot stamp, laser beam, etc., undergoes instantaneously a chemical reaction which forms a color. These heat-sensitive recording sheets have now been finding a wide range of applications, including industrial measurement recording instruments, terminal printers of computer, facsimile equipment, automatic ticket vending machines, printer for bar-code-label, and so on. In recent years, as the application of such recording is diversified and the performance of such recording equipment is enhanced, high qualities are required for heat-sensitive recording sheets. For example, even with small heat energy in a high speed recording, both the clear image with a high density and the better preservability such as better resistance to light, weather and oil, etc. are required.

In recent years, heat-sensitive recording papers are widely employed, so that the writing with a felt-pen using oily ink is often made after the recording. In this case, there is a problem in that the original color of oily ink is not obtained, since the original color is mixed with the developed color of a heat-sensitive recording sheet. For example, an oily red color of ink written on a black-color-developing heat-sensitive recording sheet is mixed with the developed black color of the heat-sensitive recording paper, so that the original red color is not obtained It is true for the colors often than a red color.

SUMMARY OF THE INVENTION

It is the object of this invention to produce a heat-sensitive recording sheet of high sensitivity which is capable of providing a clear color-writing.

The above object may be achieved as follows. The heat-sensitive recording sheet comprises a support having thereon a color-developing layer which comprises a colorless or pale colored basic chromogenic dye and an organic color-developing agent, wherein when heated, the basic chromogenic dye is reacted with the color-developing agent to develop a color, and the organic color-developing layer comprises both 4-hydroxy-4'-n-propoxydiphenylsulfone, and at least one phenolic substance selected from the group consisting of 1,2-di(3-methylphenoxy)ethane, di(p-methylbenzyl)oxalate, p-benzylbiphenyl, β-benzyloxynaphthalene and 4-biphenyl-p-tolylethe. The colorless basic dye used in this invention is not limited. However, triphenylmethane type-, fluorane type-, azaphthalide type-, and fluorene type-leuco dyes are preferable and include, for example.

Triphenylmethane leuco dye 3,3-bis(p-dimethylaminophenyl)-6-dimethylamino-phthalide (crystal violet lactone)

Fluorane leuco dyes 3-diethylamino-6-methyl-7-anilinofluorane, 3-(N-ethyl-p-toluidino)-6-methyl-7-anilinofluorane, 3-(N-ethyl-N-isoamylamino)-6-methyl-7-anilinofluorane, 3-diethylamino-6- methyl-7-(O,P-dimethylanilino)fluorane, 3-pyrolidino-6- methyl-7-anilinofluorane, 3-pyperidino-6-methyl-7anilinofluorane, 3-(N-cyclohexyl-N-methylamino)-6-methyl-7anilinofluorane, 3-diethylamino-7-(m-trifluoromethylanilino) fluorane, 3-N-n-dibutylamino-6-methyl-7-anilinofluorane, 3-N-n-dibutylamino-7-(o-chloroanilino) fluorane, 3-(N-ethyl-N-tetrahydrofurfurylamino)-6-methyl-7-anilinofluorane, 3-dibutylamino-6-methyl-7-(O,P-dimethylanilino) fluorane, 3-(N- omethyl-N-propylamino)-6-methyl-7-anilinofluorane, 3-diethylamino-6-chloro-7-anilinofluorane, 3-dibutylamino-7- c (o-chloroanilino)fluorane, 3-diethylamino-7-(o-chloroanilino)fluorane, 3-diethylamino-6-methylchlorofluorane, 3-diethylamino-6-methyl-fluorane, 3-cyclohexylamino-6-chlorofluorane, 3-diethylamino-benzo[a]fluorane.

Azaphthalide dyes 3-(4-diethylamino-2-ethoxyphenyl)-3-(1-ethyl-2-methylindole-3yl)-4-azaphthalide, 3-(4-diethylamino-2-ethoxyphenyl)-3(1-ethyl 2-methylindole-3-yl)-7-azaphthalide, 3-(4-diethylamino-2-ethoxyphenyl)-3-(1-octyl-2-methylindole-3-yl)-4-azaphthalide, 3-(4-N-cyclohexyl-N-methylamino-2- methoxyphenyl)-3-(1-ethyl-2-methylindole-3-yl)-4-azaphthalide.

Fluorene leuco dyes 3,6,6'-tris(dimethyl)spiro[fluorene-9,3'-phthalide]3,6,6'-tris(diethylamino)spiro!fluorene-9,3'-phthalide]

The above-described dyes may be used alone or in combination.

The heat-sensitive recording sheet of this invention uses as a sensitizer at least one phenolic substance selected from the group consisting of 1,2-di(3methylphenoxy)ethane, di(p-methylbenzyl)oxalate, p-benzylhiphenyl, β-benzyloxynaphthalene and 4-hiphenyl-p-tolylether. The above sensitizers are effective for the object of this invention.

The following stabilizers can be used in this invention: 4,4'-butylidene(6-t-butyl-3-methylphenol), 2,2'-di-t-butyl-5,5'dimethyl-4,4'-sulfonyldiphen, 1,1,3tris(2-methyl-4-hydroxy-5-t-butylphenyl) butane, 1,1,3tris(2-methyl-4-hydroxy-5-cyclohexyl) butane and the like.

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acidmodified polyvinyl alcohol, butyral-modified polyvinyl alcohol, other modified polyvinyl alcohol, hydroxyethyl cellulose, methyl cellulose, carboxymethyl cellulose, styrene/maleic acid anhydride copolymers, styrene/butadiene copolymers, cellulose derivatives such as ethyl cellulose, acetyl cellulose, etc.; polyvinyl chloride, polyvinyl acetate, polyacryl amide, polyacrylic acid ester, polyvinyl butyral, polystyrol and copolymers thereof; polyamide resin, silicone resin, petroleum resin, terpene resin, ketone resin and cumaron resin.

These polymeric materials may be used after they were dissolved in an solvent such as water, alcohol, ketone, ester, hydrocarbon, etc., or after they were emulsified or dispersed in water or a solvent other than water.

These binders can be used in combination depending upon the required quality.

The filler used in this invention includes or9anic and inorganic fillers. Typical examples for fillers include silica, calcium carbonate, kaolin, calcined kaolin, diatomaceous earth, talc, titanium dioxide and aluminum hydroxide.

Furthermore, the following additives can be used: releasing agent such as fatty acid metal salts, slipping agent such as waxes, UV-absorbers of benzophenone type or triazole type, water resistance agent such as glyoxal, dispersants, antifoamers and the like.

The species and the amount of organic color-developing agent, colorless basic chromogenic dye and other ingredients, which are used in this invention, are determined depending upon the performance and recording aptitude required for the recording sheet, and are not otherwise limited. However, in ordinary cases, it is suitable to use 1-8 parts by weight of organic color-developing agent, 1-20 parts by weight of filler, based on 1 part by weight of colorless basic chromogenic dye, and to add 10-25% by weight of a binder in total solid content.

The aimed heat-sensitive recording sheet may be obtained by coating the above coating material on a substrate such as paper, synthetic paper, film, plastic, etc.

For improving the preservability, further, an over-coat layer of a polymer, etc. can be formed on the color-developing layer.

The above organic color-developing agent, the above colorless basic chromogenic dye, and if necessary, other ingredients are ground to a particle size of several microns or smaller by means of a grinder or emulsifier such as a ball mill, attritor, sand grinder, etc., and binders and various additives in accordance with the purpose, are added thereto to prepare a coating material.

For improving the color-developing sensitivity, further, an under-coat layer of a polymer, the containing fillers can be formed under the color-developing layer.

The reason for providing no color-changing of the heat-sensitive recording sheet in the writing with an oily ink is assumed as follows.

In the writing with an oily ink felt-pen on a heat-sensitive recording sheet, a color-developing agent, a leuco dye and a sensitizer are dissolved in an organic solvent of the ink. With the vaporization of the solvent, a color-developing composition consisting of the color-developing agent, the leuco dye and the sensitizer is formed on a written part. Accordingly, in using a red ink, the combination of the red color with the developed color of the heat-sensitive recording sheet forms a dark image.

On the contrary, the heat-sensitive recording sheet of this invention is composed of 4-hydroxy-4'-n-propoxydiphenylsulfone, a leuco dye and a particular sensitizer, which have low solubilities to the ink solvent and which form no colored material even in the vaporization of the solvent. Therefore, it is assumed that the color-changing does not occur in the use of the oily ink Further, the color-developing agent and the dye have a high melting, dissolving and diffusion speed, as well as a great saturation solubility to the sensitized of this invention. Therefore, a color-developing compound is rapidly produced in a physico-chemical reaction among an organic color-developing agent, a sensitizer and a leuco dye, which forms a high-density color.

Furthermore, the sensitizer used in this invention can not be crystallized during the dissolution in the organic solvent of an oily ink and during the subsequent vaporization of the solvent. Accordingly, white powder is not produced in the writing with the oily ink.

EXAMPLES

The following examples illustrate this invention, although this invention is not limited to examples.

parts are parts by weight.

EXAMPLE (Test Nos. 1—5)

Liquid A (dispersion of color-developing agent)
- 4 -hydroxy-4'-n-propoxydiphenylsulfone: 6.0 parts
- 10% aqueous solution of polyvinyl alcohol: 18.8 parts
- Water: 11.2 parts Liquid B (dispersion of dye)
- 3-N-n-dibutylamino-6-methyl-7-anilinofluorane: 2.0 parts
- 10% aqueous solution of polyvinyl alcohol: 4.6 parts
- Water: 2.6 parts Liquid C (dispersion of sensitizer)
- Sensitizer (see Table 1) 4.0 parts
- 10% aqueous solution of polyvinyl alcohol 5.0 parts
- Water 3.0 parts Each liquid of the above composition was ground to an average particle size of 1 micron by a sand grinder. Then, the dispersions were mixed in the following proportion to prepare a coating material.

| Coating material | |
|---|---|
| Liquid A | 36.0 parts |
| Liquid B | 9.2 parts |
| Liquid C | 12.0 parts |
| Kaolin clay (50% aqueous dispersion) | 12.0 parts |

The coating material was applied on one side of a base paper weighing 50 g/m$^2$ in a coating amount of 6.0 g/m$^2$ and then dried. The resultant paper was treated to a smoothness of 200-600 seconds by a supercalender. In this manner, a heat-sensitive recording sheet was obtained.

Comparative Example 1 (Test Nos. 1-4)

Liquid E (dispersion of color-developing agent)
- Color-developing agent (see Table 1) 6.0 parts
- 10% aqueous polyvinyl alcohol solution 18.8 parts
- Water 11.2 parts Liquid B (dispersion of dye)
- 3-N-n-dibutylamino-6-methyl-7-anilinofluorane: 2.0 parts
- 10% aqueous polyvinyl alcohol solution: 4.6 parts
- Water: 2.6 parts Each liquid of the above composition was ground to an average particle size of 1 micron by a sand grinder. Then, the dispersions were mixed in the following proportion to prepare a coating material.

| Coating material | |
|---|---|
| Liquid E | 36.0 parts |
| Liquid B | 9.2 parts |

-continued

| Coating material | |
|---|---|
| Kaolin clay (50% aqueous dispersion) | 12.0 parts |

Each of heat-sensitive recording sheets was obtained in the same manner as in Example 1.

Comparative Example 2 (Test Nos. 5-10)

Liquid A (dispersion of color-developing agent)
4-Hydroxy-4'-n-proxydiphenylsulfone: 6.0 parts
10% aqueous solution of polyvinyl alcohol: 18.8 parts
Water: 11.2 parts
Liquid B (dispersion of dye)
3-N-n-dibutylamino-6-methyl-7-anilinofluorane: 2.0 parts
10% aqueous solution of polyvinyl alcohol: 4.6 parts
Water: 2.6 parts
Liquid F (dispersion of sensitizer)
Sensitizer (see Table 1): 4.0 parts
10% aqueous solution of polyvinyl alcohol: 5.0 parts
Water: 3.0 parts Each liquid of the above composition was ground to an average particle size of 1 micron by means of a sand grinder. Then, the dispersions were mixed in the following proportion to prepare a coating material.

| Coating material | |
|---|---|
| Liquid A | 36.0 parts |
| Liquid B | 9.2 parts |
| Liquid F | 12.0 parts |
| Kaolin clay (50% aqueous dispersion) | 12.0 parts |

Each of heat-sensitive recording sheets was obtained in the same manner as in Example 1.

The heat-sensitive recording sheets obtained by the above Example and Comparative Examples were tested for their qualities and performances. The test results are summarized in Table 1.

TABLE 1

| | Test No. | Color-developing agent | Sensitizer | Test Results: Image density Static (1) | Image density Dynamic (2) | Color-change by oily ink (3) | White powder formation (4) |
|---|---|---|---|---|---|---|---|
| Example | 1 | 4-Hydroxy-4'-n-propoxy-diphenylsulfone | 1,2-Di(3-methylphenoxy) ethane | 1.15 | 0.99 | ○ | ○ |
| | 2 | 4-Hydroxy-4'-n-propoxy-diphenylsulfone | Di(p-methylbenzyl) oxalate | 1.15 | 0.99 | ○ | ○ |
| | 3 | 4-Hydroxy-4'-n-propoxy-diphenylsulfone | p-Benzylbiphenyl | 1.14 | 0.98 | ○ | ○ |
| | 4 | 4-Hydroxy-4'-n-propoxy-diphenylsulfone | β-Benzyloxynaphthalene | 1.14 | 0.99 | ○ | ○ |
| | 5 | 4-Hydroxy-4'-n-propoxy-diphenylsulfone | 4-Biphenyl-p-tolylether | 1.15 | 1.00 | ○ | ○ |
| Comparative Example 1 | 1 | 4,4'-Isopropylidene diphenol | No addition | 0.19 | 0.20 | X | ○ |
| | 2 | 4-Hydroxybenzoic acid benzylester | No addition | 1.40 | 0.80 | X | X |
| | 3 | 4-Hydroxy-4'-isopropoxy-diphenylsulfone | No addition | 0.18 | 0.23 | X | ○ |
| | 4 | 4-Hydroxy-4'-n-propoxy-diphenylsulfone | No addition | 0.18 | 0.19 | X | ○ |
| Comparative Example 2 | 5 | 4-Hydroxy-4'-n-propoxy-diphenylsulfone | Diphenylcarbonate | 0.80 | 0.70 | Δ | X |
| | 6 | 4-Hydroxy-4'-n-propoxy-diphenylsulfone | p-toluenesulfonic acid phenylester | 0.83 | 0.76 | Δ | X |
| | 7 | 4-Hydroxy-4'-n-propoxy-diphenylsulfone | Dimethylterephthalate | 0.79 | 0.71 | Δ | X |
| | 8 | 4-Hydroxy-4'-n-propoxy-diphenylsulfone | Dibenzylterephthalate | 0.82 | 0.71 | Δ | X |
| | 9 | 4-Hydroxy-4'-n-propoxy-diphenylsulfone | 1-Hydroxy-2-naphthoic acid phenylester | 0.81 | 0.69 | Δ | X |
| | 10 | 4-Hydroxy-4'-n-propoxy-diphenylsulfone | p-Benzylbenzoic acid methylester | 0.80 | 0.68 | Δ | X |

Notes
(1) Static image density
A heat-sensitive recording sheet is pressed down for 5 seconds under pressure of 10 g/cm$^2$ on a hot plate heated at 105° C., and the optical density is measured by a Macbeth densitometer (RD-914, using amber filter which is used in the followings).
(2) Dynamic image density
A heat-sensitive recording sheet is recorded with an impressed voltage of 0.58 mj/Dot and a pulse width of 0.97 milli-seconds by using the thermal facsimile UF-1000 manufactured by Matsushita Graphic Communication Systems, Inc., and the optical density is measured by a Macbeth densitometer.
(3) Color-changing by oily ink
A heat-sensitive recording sheet is written by using a oily red-marking ink No. 500 manufactured by Teranishi Kagaku Co. The color-changing degree is observed by eyes in comparison with the pure red color.
○ . . . Little color-changing
Δ . . . Some color-changing
X . . . Remarkable color-changing
(4) White powder formation
A heat-sensitive recording sheet is written in the same manner as in (3) described above. After 15 minutes, the white powder formation is observed by eyes.
○ . . . No white powder formation
X . . . White powder formation The advantageous features of the heat-sensitive recording sheets of this invention are as follows:

(1) Excellent writing property in using a felt pen of oily ink since the color-changing and the white powder formation do not occur.
(2) Superior thermal responsibility.

We claim:

1. A heat-sensitive recording sheet comprising a support having thereon a color-developing layer which comprises a colorless or pale colored basic chromogenic dye and an organic color-developing agent, wherein when heated, said basic chromogenic dye is reacted with said color-developing agent to develop a color, and said organic color-developing layer comprises both 4-hydroxy-4'-n-propoxydiphenylsulfone as an organic color-developing agent and at least one phenolic substance selected from the group consisting of 1,2 -di(3-methylphenoxy)ethane, di(p-methylbenzyl)oxalate, and 4-biphenyl-p-tolylether.

2. The heat-sensitive recording sheet according to claim 1, wherein said color-developing layer comprises 1-8 parts by weight of said organic color-developing agent and 1-20 parts by weight of filler, based on 1 part by weight of said colorless basic chromogenic dye, and 10-25 parts by weight of binder in total solid content.

3. The heat-sensitive recording sheet according to claim 1, wherein said colorless basic chromogenic dye is at least one dye selected from the group consisting of triphenylmethane, fluorane, azaphthalide and fluorene leuco dyes.

4. The heat-sensitive recording sheet according to claim 1, wherein said color-developing layer further comprises a stabilizer.

5. The heat-sensitive recording sheet according to claim 4, wherein said stabilizer is at least one member selected from the group consisting of 4,4'-butylidene(6-t-butyl-3-methylphenol), 2,2'-di-t-butyl-5,5'-dimethyl-4,4'-sulfonyldiphenol, 1,1,3-tris(2-methyl-4-hydroxy-5-cyclohexylpheny) butane and 1,1,3-tris(1-methyl-4-hydroxy-5-t-butylphenyl) butane.

6. The heat-sensitive recording sheet according to claim 1, wherein said support is at least one member selected from the group consisting of paper, and film.

7. The heat-sensitive recording sheet according to claim 6, wherein said paper is a synthetic paper.

8. The heat-sensitive recording sheet according to claim 1, wherein an over-coat layer is formed on said color-developing layer.

9. The heat-sensitive recording sheet according to claim 1, wherein an under-coat layer is formed under said color-developing layer.

* * * * *